United States Patent [19]

Alonso

[11] 4,240,198

[45] Dec. 23, 1980

[54] METHOD OF MAKING CONDUCTIVE ELASTOMER CONNECTOR

[75] Inventor: Oscar Alonso, Westminster, Calif.

[73] Assignee: International Telephone and Telegraph Corporation, New York, N.Y.

[21] Appl. No.: 13,255

[22] Filed: Feb. 21, 1979

Related U.S. Application Data

[62] Division of Ser. No. 912,381, Jun. 5, 1978, abandoned.

[51] Int. Cl.[3] ..... H01R 43/00

[52] U.S. Cl. ..... 29/876

[58] Field of Search ..... 29/629, 630 B, 630 D, 29/626, 876, 424

[56] References Cited

U.S. PATENT DOCUMENTS

| | | | |
|---|---|---|---|
| 3,705,332 | 12/1972 | Parks | 29/626 X |
| 4,050,756 | 9/1977 | Moore | 29/628 X |
| 4,064,623 | 12/1977 | Moore | 29/629 |

FOREIGN PATENT DOCUMENTS 1136753 12/1968 United Kingdom .

*Primary Examiner*—Francis S. Husar
*Assistant Examiner*—C. J. Arbes
*Attorney, Agent, or Firm*—Thomas L. Peterson

[57] ABSTRACT

An electrical connector in which conductive rubber rods are mounted in a metal substrate covered by a nonconductive layer. The rods extend above and below the upper and lower surfaces, respectively, of the substrate for electrically interconnecting conductive traces on a pair of electronic components. A method for making the connector is disclosed.

1 Claim, 7 Drawing Figures

METHOD OF MAKING CONDUCTIVE ELASTOMER CONNECTOR

The invention described herein was made in the performance of work under a NASA contract and is subject to the provisions of Section 305 of the National Aeronautics and Space Act of 1958, Public Law 85-568 (72 Stat. 435; 42 U.S.C. 2457).

This is a division, of application Ser. No. 912,381, filed June 5, 1978, now abandoned.

BACKGROUND OF THE INVENTION

This invention relates generally to an electrical connector and, more particularly, to a conductive elastomer connector and to the method of making the same.

U.S. Pat. Nos. 4,050,756 and 4,064,623 to Moore, assigned to the assignee of the present application, disclose a conductive elastomer connector and a method of making the same of which the present invention constitutes an improvement. More specifically, the Moore patents disclose a conductive elastomer connector comprising a plastic substrate, such as Mylar oriented polyester, having a plurality of etched holes therein, conductive elastomer rods are mounted in the holes and are retained therein by the underetch pattern which is used by the etched holes. The rods extend above the upper surface and below the lower surface of the substrate so that only the rods need be engaged in order to provide an electrical conductive path through the connector. As explained in the Moore patents, such connector may be made in extremely small sizes with a very close center-to-center spacing of the conductive elastomer rods. In accordance with the Moore method, a laminate is formed consisting of a plastic substrate having metal layers on the top and bottom surfaces thereof. Aligned holes are formed in the metal layers by etching using a standard photo-resist technique. Using the two-sided metal etched hole pattern as a template, the plastic substrate is then etched to provide holes therein aligned with the holes in the metal layers. The aligned holes are then filled with conductive elastomer to form conductive elastomer rods. Thereafter, the metal layers are removed from the plastic substrate leaving the conductive rods retained in the substrate which extend above and below the top and bottom surfaces thereof.

As disclosed in the Moore patents, the connector has been constructed utilizing a 0.003 inch Mylar substrate containing 15,625 conductive elastomer rods of 4–5 mils in diameter packaged into one square inch using 8 mils center-to-center spacing. Making the connector of such small size, with a highly dense pattern of conductive rods, is difficult and the connector has a few short-comings. More specifically, it is difficult to fabricate the substrate with a uniform hole pattern for mounting the conductive rods in a connector of the size contemplated in the Moore patents. That is to say, it is difficult to etch holes of accurate size and location in a plastic or other dielectric substrate. As a result, it is difficult to accurately reproduce the hole patterns in dielectric substrates with very close center-to-center spacing of the holes to enable production of a plurality of connectors with identical patterns of conductive elastomer rods. Also, because of the high coefficient of thermal expansion of a dielectric substrate, the substrate suffers dimension drift in response to temperature changes. That is, the size of the dielectric substrate will vary in response to temperature changes with results in variations in the pattern of the conductive elastomer rods with the consequence that there may be caused misalignment of the rods with traces on the mating electronic components interconnected by the connector.

It is the purpose of the present invention to provide a novel conductive elastomer connector arrangement and method of making the same which overcomes the aforementioned problems inherent in the prior art connector when made in very small sizes.

SUMMARY OF THE INVENTION

According to the present invention, there is provided a method of making a conductive elastomer connector in which there is provided three metal plates having identical patterns of holes therein. A nonconductive layer is formed on one of the plates covering the upper and lower surfaces thereof and the walls of the holes. The plates are stacked with the coated plate disposed between the other two plates and with the holes in the three plates aligned. The holes are filled with a conductive elastomer thereby forming conductive elastomer rods in the holes. Thereafter, the outer plates are removed by etching from the intermediate plate with the conductive elastomer rods remaining in the plate thereby extending above and below the coating on the respective top and bottom surfaces thereof. Thus, the method provides a conductive elastomer connector in which conductive rods are mounted in a metal plate coated with a nonconductive layer thereby overcoming the problems inherent in the prior art connectors disclosed in the aforementioned Moore patents.

DESCRIPTION OF THE PREFERRED EMBODIMENTS

Figure 1:
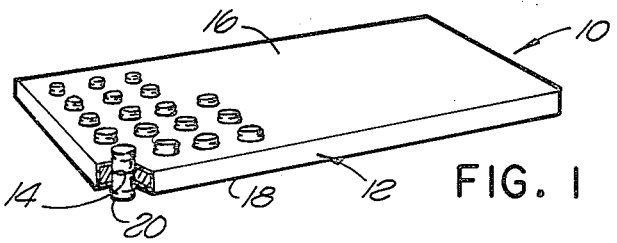
FIG. 1 is a perspective view of a conductive elastomer connector constructed in accordance with the present invention, with a portion of one corner thereof broken away to show how a conductive elastomer rod is mounted in the substrate of the connector.
Figure 2:
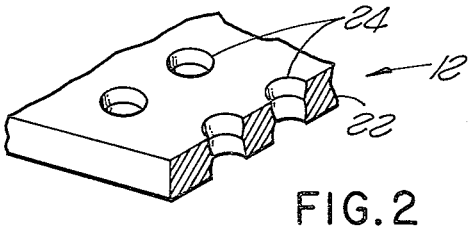
FIGS. 2 to 7 are fragmentary, perspective sectional views illustrating the various steps employed in practicing the method of the present invention to make the connector illustrated in FIG. 1.

Referring now to FIG. 1 of the drawings in detail, there is illustrated the electrical connector of the present invention, generally designated 10. The connector comprises a flat substrate 12 having a plurality of openings 14 therethrough which extend from the upper surface 16 to the lower surface 18 of the substrate. Conductive elastomer rods 20 are mounted in the holes 14. The rods extend above the upper surface 16 and below the lower surface 18 of the substrate.

In contrast to the connector disclosed in the aforementioned Moore patents which utilizes a dielectric substrate, the substrate 12 of the present invention consists of a metal plate 22 having holes 24 therethrough. A nonconductive layer 25 is applied to the plate 22 covering its upper and lower surfaces and the walls of the holes 24. The coated holes 24 in the plate 22 correspond to the holes 14 in the substrate 12 illustrated in FIG. 1.

The metal plate 22 may be formed of a relatively rigid material if used as a part of an alignment structure in an electrical interconnection arrangement. Alternatively, the plate may be in the form of a flexible or semi-flexible metal sheet, and may be used as a compliant member in complex shape factors or where control of electrical contact by camber or thickness variations are necessary. Accordingly, the term "plate" as used in this description and in the claims appended hereto is intended to include both rigid metal plates and plates or sheets of metal which are resilient or flexible. By way of example only, the metal plate may be formed of copper, aluminum or nickel. The nonconductive layer may be a plastic coating, such as an epoxy resin. If desired, the metal plate 22 may be pre-oxidized to improve the adhesion of the plastic coating thereon and the integrity of the coating. As a further alternative, the substrate 12 may consist of a metal plate which is oxidized to provide the nonconductive layer 25. For example, when the plate 22 is formed of nickel, the oxide of nickel is tightly bound to the base metal and provides an effective insulation coating for the metal substrate. A copper plate provided with an oxide film would also provide an effective substrate for the present invention. Obviously, other metals and nonconductive materials may be used to practice the present invention.

The term "conductive elastomer" utilized in the specification and the claims appended hereto is intended to mean either a compressible nonconductive elastomer filled with conductive particles, which becomes electrically conductive when compressed, or also an elastomer which is sufficiently loaded with conductive particles that it is electrically conductive even without compression. Suitable conductive fillers for use in the elastomer are disclosed in the aforementioned Moore patents, and the prior art patent referred to therein.

Reference is now made to FIGS. 2 to 7 of the drawings which illustrate the steps utilized in making the connector 10 of the present invention. First the metal plate 22 is etched, using standard photo-resist techniques, to produce the holes 24. Two other plates, designated **22*a* and 22*b* in FIG. 4, may be made at the same time that the plate 22 is formed which are etched to provide holes 24*a* and 24*b*, respectively, which are arranged in patterns identical to the pattern of the holes 24 in plate 22**.

Figure 3:
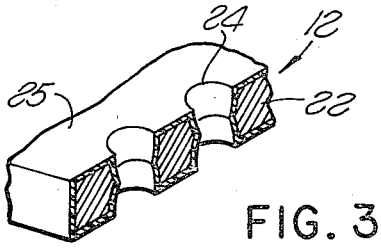

As seen in FIG. 3, the plate 22 is coated with a nonconductive layer 25, such as by diluting an epoxy resin and spraying the diluted resin in a very thin film over all the exposed surfaces of the plate 22. The resin film is allowed to cure by drying or heating, thus providing the completed substrate 12. Thereafter, the bottom surface of the plate **22*a* and the upper surface of the plate 22*b* are sprayed with a thin film of the same epoxy resin. The plates 22*a* and 22*b*** are dried to cause the solvent in the epoxy resin solution to evaporate.

Figure 4:
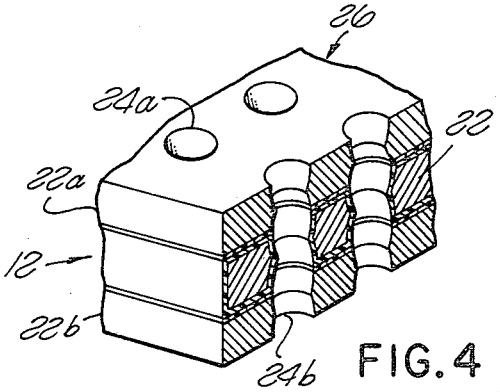

Thereafter, the plates **22*a* and 22*b* are stacked with the substrate 12 disposed therebetween in the manner illustrated in FIG. 4, with the plates disposed so that the identical hole patterns therein are aligned. The stacked plates are then mounted in a press and compressed and cured to produce a laminate, generally designated 26**.

Figure 5:
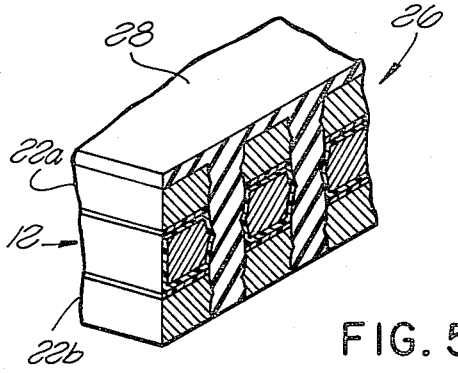
Figure 6:
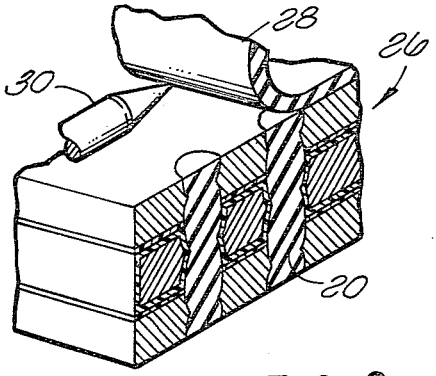
Figure 7:
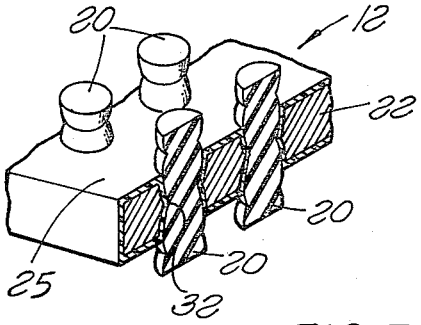

A layer 28 of conductive elastomer, preferably a conductor-filled silicone rubber, is then placed on top of the laminate 26. The laminate with the conductive layer 28 is then compressed in a mold, causing some of the elastomer to be squeezed into and completely fill the openings in the laminate, as seen in FIG. 5. For silicone rubber, the mold is preferably heated to about 350° F. After the molding operation, the excess flash of the layer 28 is removed from the upper surface of the laminate by the use of a suitable tool, as indicated at 30, thus leaving conductive elastomer rods 20 in the laminate extending from the upper surface thereof to the lower surface. The metal plates **22*a*, 22*b* are then etched away, leaving the conductive elastomer rods 20 formed in the desired pattern within the substrate 12, as seen in FIG. 7**.

As in the connector disclosed in the aforementioned Moore patents, the inwardly extending annular ridges 32 on the underetched holes 24 in plate 22 serve to retain the conductive elastomer rods 20 in the substrate.

A connector in accordance with the present invention has been constructed utilizing a 3 mil. thick pre-oxidized copper plate 22 for the substrate and a high temperature epoxy resin sold under the designation EC2290 by 3M Company as the epoxy resin which forms the nonconductive layer 25 of the substrate. The epoxy was diluted with methylethylketone in a ratio of about 5 to 1 to provide a relatively thin solution of the epoxy which was suitable for spraying a thin film over the surface of the copper plate. The copper plate was baked in an oven at about 400° F. for approximately one-half hour in order to cure the epoxy resin film. The resulting film thickness was between 0.1 to 0.2 mil. The plates **22*a*, 22*b* were identical to the copper plate 22**. The connector contained 16,384 conductive elastomer rods of 4–5 mils. in diameter packaged into one square inch on 200 micron center-to-center spacing.

The connector of the invention has the advantage over the prior art conductive elastomer connector utilizing a dielectric substrate in that it is easier to reproducibly fabricate the metal plate 22 with a uniform hole pattern so that there is achieved greater dimensional accuracy of the size and location of the conductive elastomer rods 20 in the connector of the invention. Further, the substrate 12 of the present invention utilizing a metal plate 22 has a substantially lower coefficient of thermal expansion than the dielectric substrate in the prior art connector so that the present invention substantially reduces, if not eliminates, the dimension drift problem with variations in temperature inherent in the prior art connector. Therefore, the connector of the present invention is a more stable structure which minimizes misalignment of the conductive elastomer rods 20 with conductive traces on the components which the connector interconnects. Another, and very important advantage of the invention, is the substantial reduction in electrical leakage, which normally results in cross talk and noise between adjacent conductive elastomer rods, which may be achieved in the present invention by grounding the metal plate 22 of the substrate 12. Thus, in the present invention, any electrical leakage out of one of the conductive elastomer rods will pass to ground via the grounded plate 22 rather than to the next adjacent rod.

While the invention has been described with respect to a connector in which the elastomer rods 12 are retained in the substrate by means of an underetched pattern formed in the holes 24 in the plate 22, it will be appreciated that the advantageous features of the invention achieved by the use of the metal plate 22 may also be realized by retaining the conductive elastomer rods in the holes in the plate by other arrangements, such as by providing buttons on the tops and bottoms of the rods which engage the top and bottom surfaces, respectively, of the substrate 22.

What is claimed is:

1. A method of making a conductive elastomer connector comprising the steps of:

providing three metal plates each having a set of holes therein, the holes in said sets being arranged in identical patterns;

the holes in at least one of said plates being formed by etching;

forming a nonconductive layer on said one of said plates covering the upper and lower surfaces thereof and the walls of said holes;

stacking said plates with said one plate disposed between the other two plates and with the sets of holes in the three plates aligned;

filling said holes with a conductive elastomer thereby forming conductive elastomer rods in said holes; and removing by etching said other two plates from said one plate with said conductive elastomer rods remaining in said plate thereby extending above and below the coating on the respective top and bottom surfaces thereof.

* * * * *